US005885169A

United States Patent [19]

Ishizuka

[11] Patent Number: 5,885,169

[45] Date of Patent: Mar. 23, 1999

[54] SHAFT AND HEAD FOR GOLF CLUB

[75] Inventor: Motoaki Ishizuka, Yokosuka, Japan

[73] Assignee: Tokyo Koushin Co., Ltd., Tokyo, Japan

[21] Appl. No.: 842,811

[22] Filed: Apr. 17, 1997

[30] Foreign Application Priority Data

Apr. 17, 1996 [JP] Japan ..... 8-119737

[51] Int. Cl.[6] ..... A63B 53/02

[52] U.S. Cl. ..... 473/305; 473/319; 473/349

[58] Field of Search ..... 473/316, 317, 473/318, 319, 320, 321, 305, 308, 290, 310, 311, 349

[56] References Cited

U.S. PATENT DOCUMENTS 976,267 11/1910 Knight ..... 473/316
5,385,767 1/1995 Noguchi ..... 428/36.91
5,616,086 4/1997 Chappell ..... 473/290

FOREIGN PATENT DOCUMENTS 60-31743 9/1985 Japan .
62-59058 4/1987 Japan .

*Primary Examiner*—Sebastiano Passaniti
*Assistant Examiner*—Stephen L. Blau
*Attorney, Agent, or Firm*—Dilworth &Barrese

[57] ABSTRACT

Disclosed is a golf club shaft ensuring improved durability and stability in direction in which a golf ball travels, irrespective of the intensity of a golfer's force.

The diameter of a main pipe (3) is enlarged over the entire length thereof to such an extent as to allow a suppression of flexure at the time of a swing. From a head side end (4) to a grip side end (5), the main pipe (3) is configured to be tapered or straight within a range of 0/1000 to 5/1000. The main pipe (3) is fashioned into a reversely tapered golf club shaft (1), a straight golf club shaft (11) or a positively tapered golf club shaft (21).

11 Claims, 5 Drawing Sheets

SHAFT AND HEAD FOR GOLF CLUB

BACKGROUND OF THE INVENTION

1. Field of the Invention

The present invention relates generally to a shaft and a head for a golf club, and more particularly to a golf club shaft having an improved directionality at the time of a shot and a golf club head adapted to be connected to the golf club shaft.

2. Description of the Related Arts

A typical golf club shaft is of an overall length of 43 to 45 inches and is tapered with the head side diameter of about 8.5 mm for wood and about 9.4 mm for iron, and with the rear end diameter of about 15.0 mm for both. Due to the reduced diameter at its extremity, such a shaft has a higher flex and therefore is twisted to a large extent when the head tip or the heal hits a golf ball upon a shot, resulting in a poor ball directionality as well as a reduced carry.

Conceivable as measures for restricting the twisting of the shaft is to increase the thickness of a portion subjected to the stress or alternatively to reinforce the portion by means of a member having a higher rigidity. However, Such measures would give birth to a heavier overall weight or a greater shock and therefore permit only some advanced or powerful golfers to use the golf club.

For this reason, with the aim of improving the ball directionality and carry without reinforcing in particular the shaft itself, Japanese Utility Model Pub. No. Sho60-31743 discloses a shaft which is configured to be substantially straight from the tip to the rear end, with a taper within a range of 9/1000 to 4/1000 so as to secure the same diameter as the conventional shaft, thereby making the shaft itself flexible and reducing the diameter of the shaft as well as the air resistance at the time of a swing, to consequently ensure a faster head speed and therefore an improved carry. Japanese Utility Model Laid-open Pub. No. Sho62-59058 proposes a golf club shaft and a grip which are both configured to be straight so as to prevent a greater twisting action from occurring at a portion of the shaft in the vicinity of the head upon a shot and to inhibit an unstable orientation of the club face, thereby ensuring an easy control of the ball directionality as well as allowing the shaft flexure to appear overall without being localized only on the shaft tip side, to consequently achieve a greater restitution and an increase in carry.

It is however a fundamental premise for both that the shaft is flexible in the same manner as the conventional golf club shaft. It would therefore be essentially impossible to enlarge the diameter, which results in a lowered flex and a less shaft flexure. On the contrary, too small a shaft diameter in view of the sufficient shaft flexure will result in a lowered strength at the portion of the shaft in the vicinity of the head, so that a great twisting action may occur at the time of a shot depending on the position of the head which hits the ball, which will bring about an unstable orientation of the club face or a risk to damage the shaft itself. Thus, it was extremely troublesome to obtain a well-balanced shaft ensuring a proper strength at the portion of the shaft in the vicinity of the head as well as a good shaft flexure, since coordination must be made in consideration for materials and thickness of the shaft, the intensity of the golfer's force, etc.

SUMMARY OF THE INVENTION

The present invention was conceived to deal with the above problems. It is therefore an object of the present invention to provide a golf club shaft and a head associated therewith, ensuring improved durability and stability in direction in which a golf ball travels, irrespective of the intensity of a golfer's force.

The present invention has broken with a conventional common sense on a golf club shaft including the fundamental premise that it should have a higher flex to sufficiently flex the shaft. Thus, without regard to the flexure of the shaft which has hitherto constituted the premise, and without increase in thickness of a portion subjected to a stress, and without need to reinforce that portion by means of a member having a higher rigidity, the present invention was derived from an exactly novel concept.

According to a first aspect of the present invention, there is provided a golf club shaft comprising a main pipe having a diameter enlarged to such an extent as to allow a suppression of flexure of the shaft at the time of a swing of a golf club, thereby imparting an overall strength to the shaft to lower its flex, to prevent the shaft itself from being damaged while simultaneously restricting a torsion at the extremity upon a shot, to improved the stability in direction in which a golf ball travels.

According to a second aspect of the present invention, there is provided a golf club head comprising a shaft insertion socket having a diameter enlarged in accordance with the enlarged diameter of the golf club shaft constructed as described above so as to allow a direct connection with the golf club shaft; and a shaft insertion neck having a length reduced so as to be inversely proportional to the extent of enlargement in diameter of the shaft insertion socket, thereby lowering the position of center of gravity to enhance the effects presented by the golf club shaft.

BRIEF DESCRIPTION OF THE DRAWINGS

The above and other objects, aspects, features and advantages of the present invention will become more apparent from the following detailed description with reference to the accompanying drawings, in which.

DESCRIPTION OF THE PREFERRED EMBODIMENTS

Figure 1A:
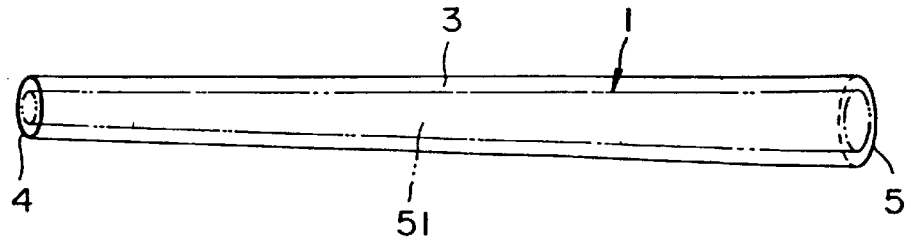
FIGS. 1A to 1C are perspective views showing embodiments of a golf club shaft of the present invention.

The present invention is directed to a golf club shaft including a main pipe with an enlarged diameter over the entire length thereof to such an extent as to suppress a flexure of the shaft upon a swing, thereby lowering a flex of the shaft as well as restraining a torsion from occurring at its extremity.

The diameter of the main pipe is thus enlarged over the entire length thereof to such an extent enough to suppress the flexure of the golf club, whereby the flex of the shaft is lowered and its strength is accordingly increased so that the extremity is restrained from being twisted upon a shot, while simultaneously the surface area of the shaft is increased to facilitate a dispersion of a shock at the time of a shot so that a stress applied to the shaft is reduced, preventing any possible damage of the shaft. Furthermore, due to the flex lowered to such an extent as to allow the flexure of the shaft to be suppressed, a time lag is significantly reduced between a sense of turn of wrists at the shot and an instant at which a head actually hits against a ball, thereby enabling a force applied upon the impact to be effectively dedicated to the shot.

The thus constructed main pipe of the golf club shaft in accordance with the present invention is configured to have a positive taper, a straight contour, or a reverse taper in a range of $^{0}/_{1000}$ to $^{5}/_{1000}$.

By imparting to the main pipe the positive taper, the straight contour or the reverse taper in the range of $^{0}/_{1000}$ to $^{5}/_{1000}$ in this manner, the diameter of the shaft is evened out over the entire length thereof, leading to a generally uniformed shaft strength.

The main pipe of the golf club shaft constructed in accordance with the present invention is elongated within a range ensuring a suppression of the flexure of the shaft at the time of swing.

By increasing the length of the main pipe within the range ensuring a suppression of the flexure of the shaft at the time of a swing in this manner, the head moving distance upon the shot is extended, resulting in an improved carry by virtue of an increase in the centrifugal force.

The present invention is also directed to a golf club head having a shaft insertion socket with an enlarged diameter allowing a direct connection with the golf club shaft constructed as set forth hereinabove.

The diameter of the shaft insertion socket of the golf club head is thus enlarged so as to allow a direct connection with the golf club shaft constructed as set forth above, whereby a stress to be applied upon a shot can be smoothly transmitted to the shaft in a dispersed manner.

The golf club head constructed in accordance with the present invention is provided with a shaft insertion neck shortened so as to be inversely proportional to the extent of enlargement in diameter of the shaft insertion socket of the golf club head.

By reducing the length of the shaft insertion neck of the golf club head so as to be inversely proportional to the extent of the enlargement in diameter of the shaft insertion socket of the golf club head in this manner, the center of gravity is lowered and approaches the head, ensuring a more accurate shot.

The present invention will now be described with reference to the accompanying drawings which illustrate embodiments of the present invention in a non-limitative manner.

A golf club shaft of the present invention includes a main pipe made of a synthetic resin reinforced by a fibrous reinforcement, for instance, carbon fiber reinforced plastics which are reinforced by strong carbon fibers having a higher modulus of elasticity.

Figure 1B:
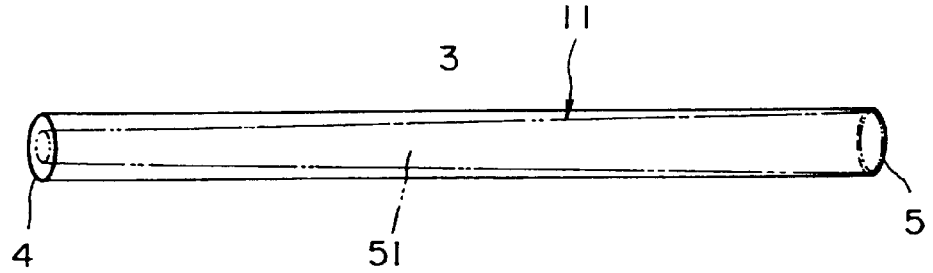
Figure 1C:
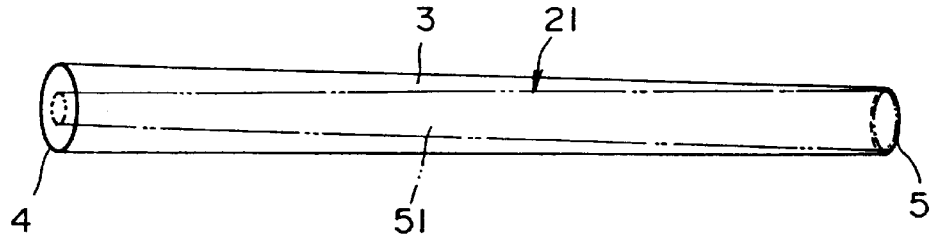

Referring to FIGS. 1A to 1C, the main pipe is generally designated at 3 and has a head side end 4 and a grip side end 5. The main pipe 3 has an enlarged diameter over the entire length thereof, for instance, the diameter of the head side end 4 being 14.0 to 17.0 mm which corresponds nearly to twice that of the conventional shaft, the diameter of the grip side end 5 being 15.0 to 16.0 mm which is substantially equivalent to that of the conventional shaft. From the head side end 4 to the grip side end 5, the main pipe 3 is tapered or straight within a range of $^{0}/_{1000}$ to $^{1}/_{1000}$. For example, golf club shafts 1, 11 and 21 are comprised respectively of reversely tapered, straight and positively tapered main pipes 3, thereby suppressing the flexure at the time of a swing as well as presenting a lower flex than that of the conventional shaft.

Figure 1D:
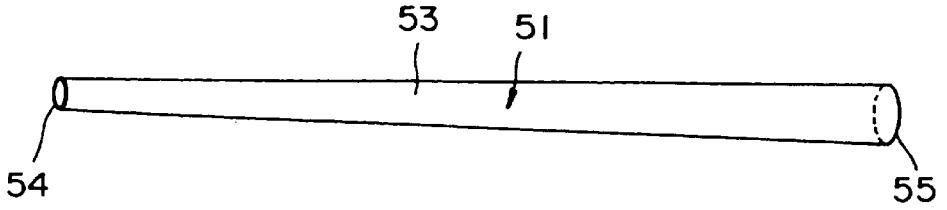
FIG. 1D is a perspective view of a conventional golf club shaft.

FIG. 1D illustrates a conventional golf club shaft 51 including a main pipe 53 having a head side end 54 of 8.5 mm in diameter which is much smaller than that of a grip side end 55. In order to make clear differences between the shaft 51 and the above-described golf club shafts 1, 11 and 21, the shaft 51 is indicated by chain double-dashed lines in FIGS. 1A to 1C.

Figure 2A:
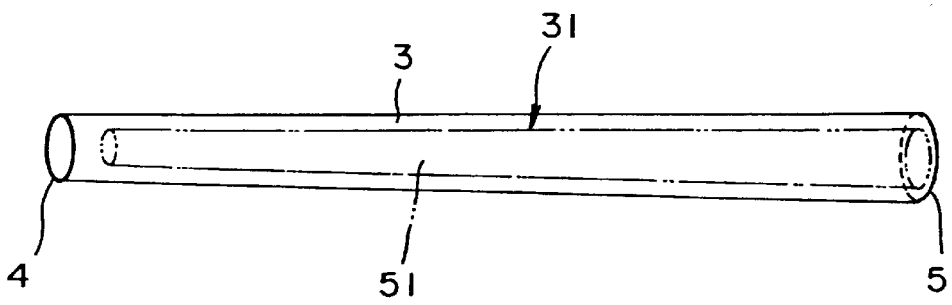
FIG. 2A is a perspective view of another embodiment of a golf club shaft of the present invention.
Figure 2B:
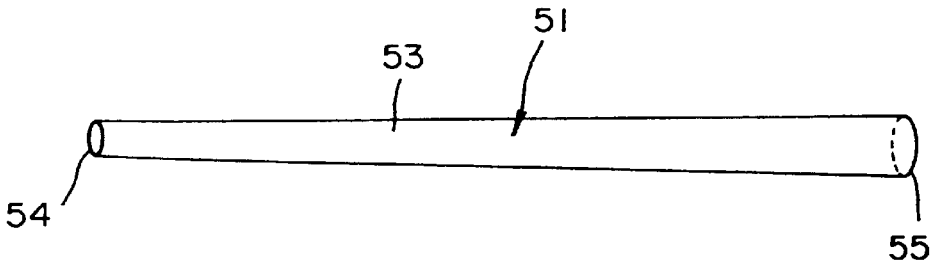
FIG. 2B is identical to FIG. 1D which is the perspective view of the conventional golf club shaft.

Referring to FIG. 2A, a golf club shaft 31 of the present invention is shown including a main pipe 3 which is not only enlarged in diameter over the entire length thereof but also increased in length within a range allowing a suppression of the flexure at the time of a swing. For instance, the FIG. 2A golf club shaft 31 has a length of 48 inches which is greater than 45 inches, the length of the conventional golf club shaft 51 shown in FIG. 2B. In order to make clear a difference between the shaft 31 and the conventional golf club shaft 51, the latter is indicated by a chain double-dashed line in FIG. 2A.

Although the golf club shaft of the present invention is so configured as to counter a concept of securement of a well-balanced, sufficient flexure which was a common sense for the conventional golf club shaft, a golf club fitted with the golf club shaft of the present invention ensures an improved stability in a direction in which a ball travels due to a general increase in strength of the shaft itself and ensures an effective utilization of the centrifugal force due to its increased length, thereby overcoming a reduction in carry arising from a lowering in swing speed due to a rise in air resistance caused by the enlarged shaft diameter, as well as from a lowering in head speed due to lowering of flex and suppression of flexure, to consequently achieve an improvement in carry.

Figure 4A:
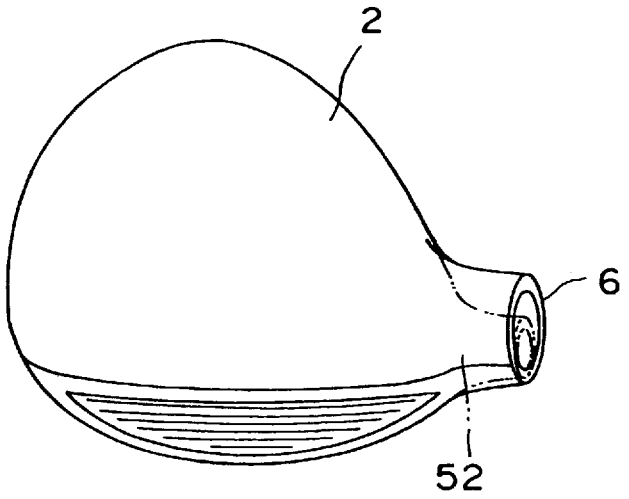
FIG. 4A is a top plan view of the embodiment of the golf club head of the present invention.
Figure 4B:
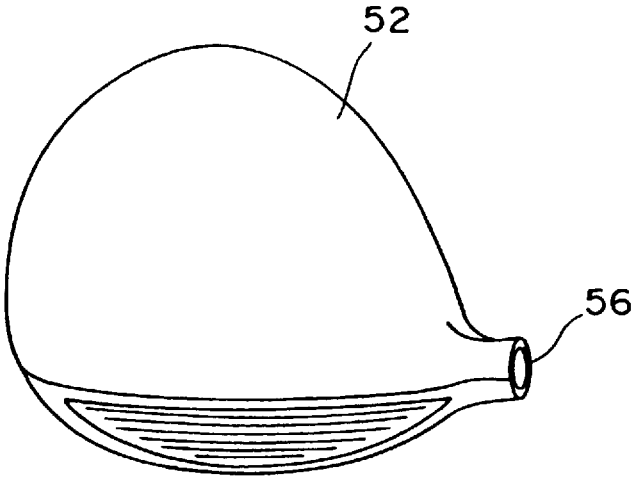
FIG. 4B is a top plan view of the conventional golf club head.

Referring to FIG. 4A, a golf club head 2 of the present invention is provided with a golf club shaft insertion socket 6 having an enlarged diameter equivalent to the shaft diameter which has been enlarged as described hereinabove, so as to allow a direct connection with the golf club shaft constructed in accordance with the present invention. In order to make clear a difference between the golf club head 2 and a conventional golf club head 52 shown in FIG. 4B, the latter is indicated by a chain double-dashed line in FIG. 4A.

Figure 3A:
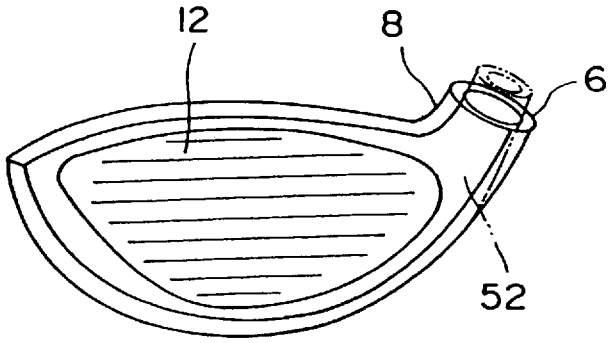
FIG. 3A is a front elevational view of an embodiment of a golf club head of the present invention.
Figure 3B:
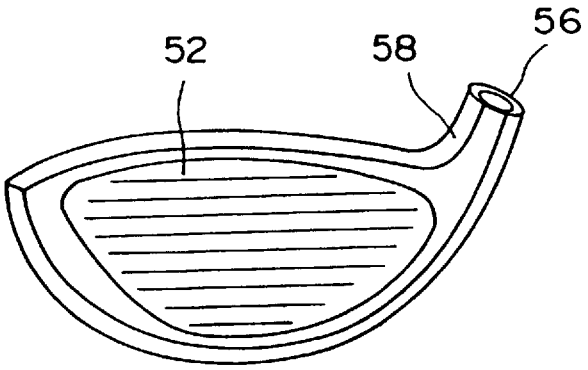
FIG. 3B is a front elevational view of a conventional golf club head.

Referring to FIG. 3A, a golf club head 12 of the present invention is provided with a shaft insertion neck 8 shortened so as to be inversely proportional to the extent of enlargement in diameter of the shaft insertion socket 6 of the golf club head, the enlargement being made in conformity with the diameter of the golf club shaft of the present invention. Employed as a reference for conventional articles is a golf club head provided with a golf club shaft insertion socket 56 having a diameter of 8.5 mm and with an insertion neck 58 having a length of 30 mm. For instance, if the diameter of the insertion socket 6 is 14.0 mm which is 1.6 times the reference diameter of the conventional articles, then the length of the insertion neck 8 will be 18.2 mm which is 1/1.65 times the reference length as a result of calculation of the insertion area. If the diameter of the insertion socket 6 is 17.0 mm which is twice the reference diameter of the conventional articles, then the length of the insertion neck 8 will be 15 mm which is half of the reference length also as a result of calculation of the insertion area. In order to make clear a difference between the golf club head 12 and the conventional golf club head 52 shown in FIG. 3B, the latter is indicated by a chain double-dashed line in FIG. 3A.

Thus, the present invention provides a golf club sufficiently ensuring effects presented by the golf club shaft constructed as hereinabove described, through a combination of the above golf club shaft with the golf club head constructed as hereinbefore set forth.

According to the present invention, as described above, the strength of the shaft is heightened without increasing the thickness of the shaft or without reinforcement by means of specific members, so that there can be provided a golf club in which the shaft itself is not too heavyweight and an improved directionality is ensured irrespective of the intensity of a golfer's force.

In addition, the diameter of the main pipe is enlarged over the entire length thereof and is made substantially constant, so that the shock is liable to be dispersed, resulting in the main pipe hard to break and capable of being elongated.

Furthermore, by virtue of the suppression of the flexure of the shaft, a time lag is reduced to the utmost extent between the sense at a shot and the instant of actual impact, facilitating the acquisition of good timing to apply a force and enabling the force applied to be effectively utilized for the shot.

Figure 5A:
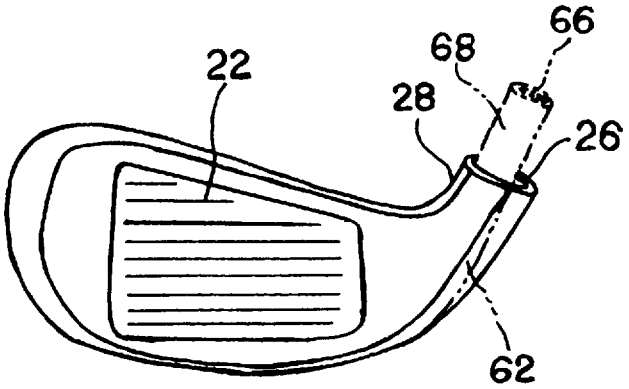
FIG. 5A is a front elevational view of an alternative embodiment of the golf club head of the present invention.
Figure 5B:
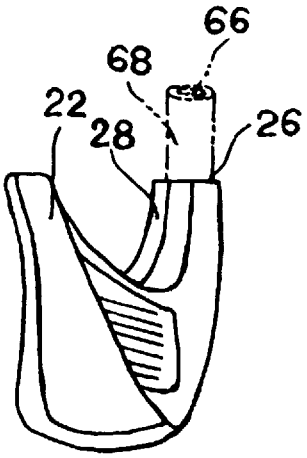
FIG. 5B is a left side elevational view thereof.

It is to be appreciated that the golf club head of the present invention is not intended to be limited to wood as shown in FIGS. 3A and 4A but includes iron as shown in FIGS. 5A and 5B. A golf club head 22 of the present invention comprises a golf club shaft insertion socket 26 having a diameter enlarged in conformity with the diameter of the golf club shaft of the present invention constructed as described hereinabove; and a shaft insertion neck 28 shortened so as to be inversely proportional to the extent of enlargement in diameter of the shaft insertion socket 26. Employed as a reference for conventional articles is an iron golf club head 62 provided with a golf club shaft insertion socket 66 having a diameter of 9.4 mm and with an insertion neck 68 having a length (depth) of 35 mm. For instance, if the diameter of the insertion socket 26 is 14.1 mm which is 1.5 times the reference diameter of the conventional articles, then the length of the insertion neck 28 will be 23.3 mm which is 1/1.5 times the reference length as a result of calculation of the insertion area. If the diameter of the insertion socket 26 is 15.0 mm which is 1.6 times the reference diameter of the conventional articles, then the length of the insertion neck 28 will be 21.9 mm which is 1/1.6 times the reference length also as a result of calculation of the insertion area. In order to make clear a difference between the golf club head 22 and the conventional golf club head 62, the latter is indicated by a chain double-dashed line in FIGS. 5A and 5B.

What is claimed is:

1. The combination of a golf club head and shaft, wherein said golf club shaft comprises a main pipe, said main pipe structured and arranged to have a diameter enlarged over the entire length thereof to such an extent as to allow a suppression of flexure at the time of a swing, thereby lowering the flex of said shaft, and said golf club head comprises a shaft insertion socket, said socket having a diameter enlarged so as to allow a direct connection with said golf club shaft, further comprising a shaft insertion neck, the length of said neck being reduced so as to be inversely proportional to the extent of enlargement in diameter of said shaft insertion socket.

2. The combination of claim 1, wherein the length of said neck is directly inversely proportional to the extent of enlargement in diameter of said shaft insertion socket, thereby lowering center of gravity towards said golf club head.

3. The combination of claim 1, wherein said golf club head is a wood golf club head or an iron golf club head.

4. The combination according to claim 1, wherein said main pipe is made of a synthetic resin reinforced by a fibrous reinforcement.

5. The combination according to claim 4, wherein said main pipe is made of carbon fiber reinforced plastics which are reinforced by strong carbon fibers having a higher modulus of elasticity.

6. The combination of a golf club head and shaft, wherein said golf club shaft comprises a main pipe, said main pipe structured and arranged to have a diameter enlarged over the entire length thereof to such an extent as to allow a suppression of flexure at the time of a swing, thereby lowering the flex of said shaft, and said golf club head comprises a shaft insertion socket, said socket having a diameter enlarged so as to allow a direct connection with said golf club shaft, wherein said main pipe is configured to be positively tapered or straight or reversely tapered within a range of $^{0}/_{1,000}$ to $^{5}/_{1000}$, and wherein said golf club head further comprises a shaft insertion neck, the length of said neck being reduced so as to be inversely proportional to the extent of enlargement in diameter of said shaft insertion socket.

7. The combination according to claim 6, wherein the length of said neck is directly inversely proportional to the extent of enlargement in diameter of said shaft insertion socket, thereby lowering center of gravity towards said golf club head.

8. The combination of a golf club head and shaft, wherein said golf club shaft comprises a main pipe, said main pipe structured and arranged to have a diameter enlarged over the entire length thereof to such an extent as to allow a suppression of flexure at the time of a swing, thereby lowering the flex of said shaft, and said golf club head comprises a shaft insertion socket, said socket having a diameter enlarged so as to allow a direct connection with said golf club shaft, wherein said main pipe is elongated within a range allowing a suppression of flexure at the time of a swing, and wherein said golf club head further comprises a shaft insertion neck, the length of said neck being reduced so as to be inversely proportional to the extent of enlargement in diameter of said shaft insertion socket.

9. The combination according to claim 8, wherein the length of said neck is directly inversely proportional to the extent of enlargement in diameter of said shaft insertion socket, thereby lowering center of gravity towards said golf club head.

10. The combination of a golf club head and shaft, wherein said golf club shaft comprises a main pipe, said main pipe structured and arranged to have a diameter enlarged over the entire length thereof to such an extent as to allow a suppression of flexure at the time of a swing, thereby lowering the flex of said shaft, and said golf club head comprises a shaft insertion socket, said socket having a diameter enlarged so as to allow a direct connection with said golf club shaft, wherein said main pipe is configured to be positively tapered or straight or reversely tapered within a range of 0/1,000 to 5/1,000 and is elongated within a range allowing a suppression of flexure at the time of a swing, and wherein said golf club head further comprises a shaft insertion neck, the length of said neck being reduced so as to be inversely proportional to the extent of enlargement in diameter of said shaft insertion socket.

11. The combination according to claim 10, wherein the length of said neck is directly inversely proportional to the extent of enlargement in diameter of said shaft insertion socket, thereby lowering center of gravity towards said golf club head.

* * * * *